US007780544B2

(12) United States Patent
Anton

(10) Patent No.: US 7,780,544 B2
(45) Date of Patent: Aug. 24, 2010

(54) SYSTEM AND METHOD FOR INDICATING A GOLF SWING REGION

(75) Inventor: Terrence Anton, Tallequah, OK (US)

(73) Assignee: Snag, Inc., Tallequah, OK (US)

( * ) Notice: Subject to any disclaimer, the term of this patent is extended or adjusted under 35 U.S.C. 154(b) by 417 days.

(21) Appl. No.: 11/842,377

(22) Filed: Aug. 21, 2007

(65) Prior Publication Data

US 2008/0051209 A1 Feb. 28, 2008

Related U.S. Application Data

(60) Provisional application No. 60/823,348, filed on Aug. 23, 2006.

(51) Int. Cl.
*A63B 69/36* (2006.01)

(52) U.S. Cl. ..... 473/257; 473/266

(58) Field of Classification Search ..... 473/270, 473/409, 218, 257, 266, 278
See application file for complete search history.

(56) References Cited

U.S. PATENT DOCUMENTS 4,915,387 A * 4/1990 Baxstrom ..... 473/218
5,645,494 A * 7/1997 Dionne et al. ..... 473/278
6,001,026 A * 12/1999 Breneman ..... 473/261
6,561,920 B1 * 5/2003 Hamilton ..... 473/257
6,595,866 B1 * 7/2003 McDaniel et al. ..... 473/261
6,932,712 B2 * 8/2005 Cardosi ..... 473/261
7,144,339 B1 12/2006 Towsen
7,214,146 B1 * 5/2007 Gersang ..... 473/409
7,238,118 B1 7/2007 Terrill
7,597,632 B2 * 10/2009 Edwards et al. ..... 473/265
2005/0090323 A1 * 4/2005 Kellogg ..... 473/218
2005/0227774 A1 * 10/2005 Buck ..... 473/218
2007/0173339 A1 * 7/2007 Rivard ..... 473/266
2008/0051209 A1 * 2/2008 Anton ..... 473/270

* cited by examiner

*Primary Examiner*—Raleigh W. Chiu
(74) *Attorney, Agent, or Firm*—James H. Beusse; Beusse Wolter Sanks Mora & Maire, P.A.

(57) ABSTRACT

A system is provided for indicating a region of a golf swing. The system includes a strip configured to encircle the feet of a golfer preparing to conduct the golf swing of a golf club. The strip is marked with one or more markings for a respective golf swing region. More particularly, the strip is positioned such that during an outer extremity of the golf swing region, the golf club is positioned above a respective marking.

14 Claims, 3 Drawing Sheets

SYSTEM AND METHOD FOR INDICATING A GOLF SWING REGION

SPECIFIC DATA RELATED TO THE INVENTION

This application claims the benefit of U.S. Provisional Application No. 60/823,348 filed Aug. 23, 2006.

FIELD OF THE INVENTION

The present invention relates to golf training equipment, and more particularly, to a system and method for indicating a golf swing region.

BACKGROUND OF THE INVENTION

In the sport of golf, in order to achieve a moderate level of success, a golfer needs to overcome several skill challenges. For example, when gripping the golf club, the golfer needs to position his/her hands in a proper arrangement on the golf grip, and refrain from gripping the grip too tight. Additionally, when standing over a shot, a golfer needs to position his/her feet in a proper arrangement relative to the ball, and flex his/her knees and back to achieve an ideal posture.

In addition to these skill challenges, a golfer needs to decide what style of golf shot to play, such as whether to hit a chip shot or a pitch shot, for example. In making this decision, the golfer needs to determine how far he/she needs to swing the golf club in order to reach the target distance, particularly for a golf shot which requires less than a full swing of the golf club.

Accordingly, it would be advantageous to provide a system which indicates a golf swing region for one or more style of golf shots, and that a golfer could use during a practice session to remember how far he/she needs to swing the golf club for a particular style of golf shot.

BRIEF DESCRIPTION OF THE INVENTION

In one embodiment of the present invention, a system is provided for indicating a region of a golf swing. The system includes a strip configured to encircle the feet of a golfer preparing to conduct the golf swing of a golf club. The strip is marked with one or more markings for a respective golf swing region. More particularly, the strip is positioned such that during an outer extremity of the golf swing region, the golf club is positioned above a respective marking.

In one embodiment of the present invention, a method is provided for indicating a region of a golf swing. The method includes providing a strip to encircle the feet of a golfer who is preparing to conduct the golf swing of a golf club. The step of providing the strip includes marking the strip with one or more markings for a respective golf swing region. During an outer extremity of a golf swing region, the golf club is positioned above a respective marking.

BRIEF DESCRIPTION OF THE DRAWINGS

A more particular description of the embodiments of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

Figure 1:
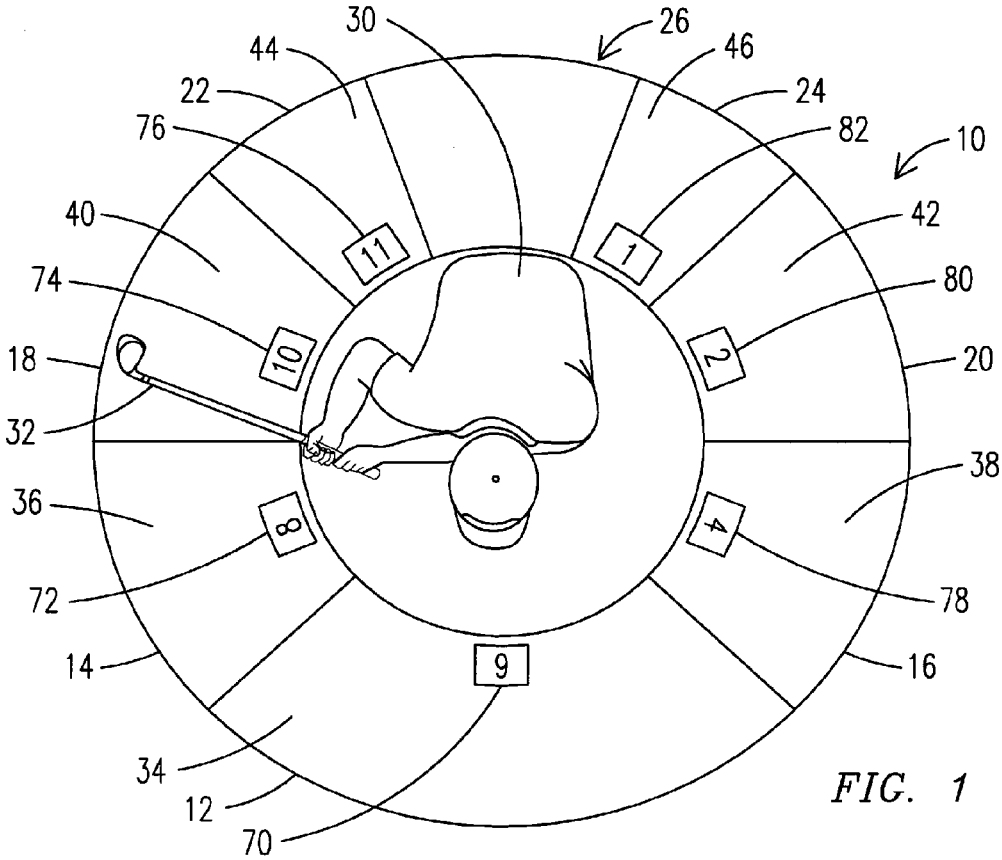
FIG. 1 is a top plan view of an exemplary embodiment of a system for indicating a golf swing region during the top of a backswing portion of the golf swing region.
Figure 2:
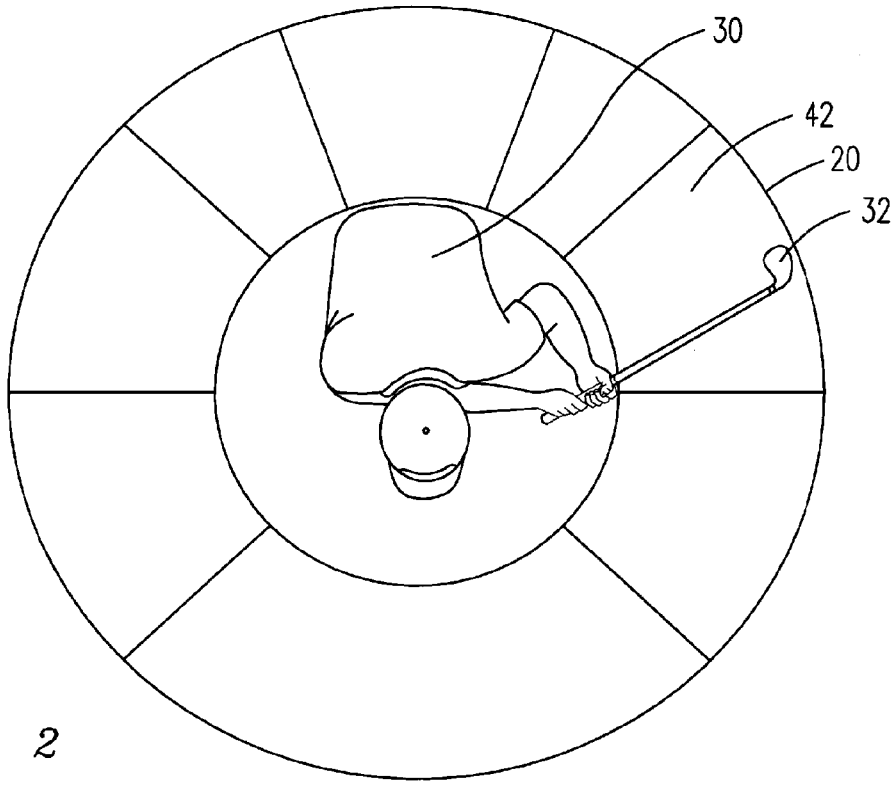
FIG. 2 is a top plan view of an exemplary embodiment of a system for indicating a golf swing region during the top of a followthrough portion of the golf swing region.
Figure 3:
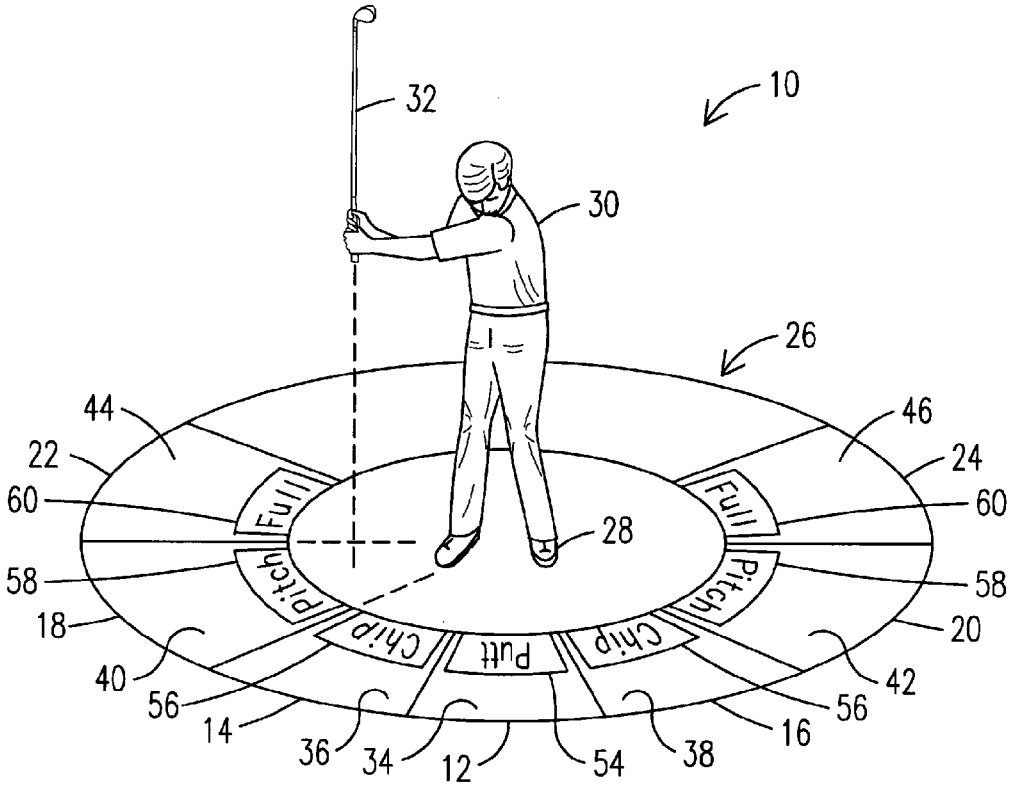
FIG. 3 is a top plan view of an exemplary embodiment of a system for indicating a golf swing region during the top of a backswing portion of the golf swing region.
Figure 4:
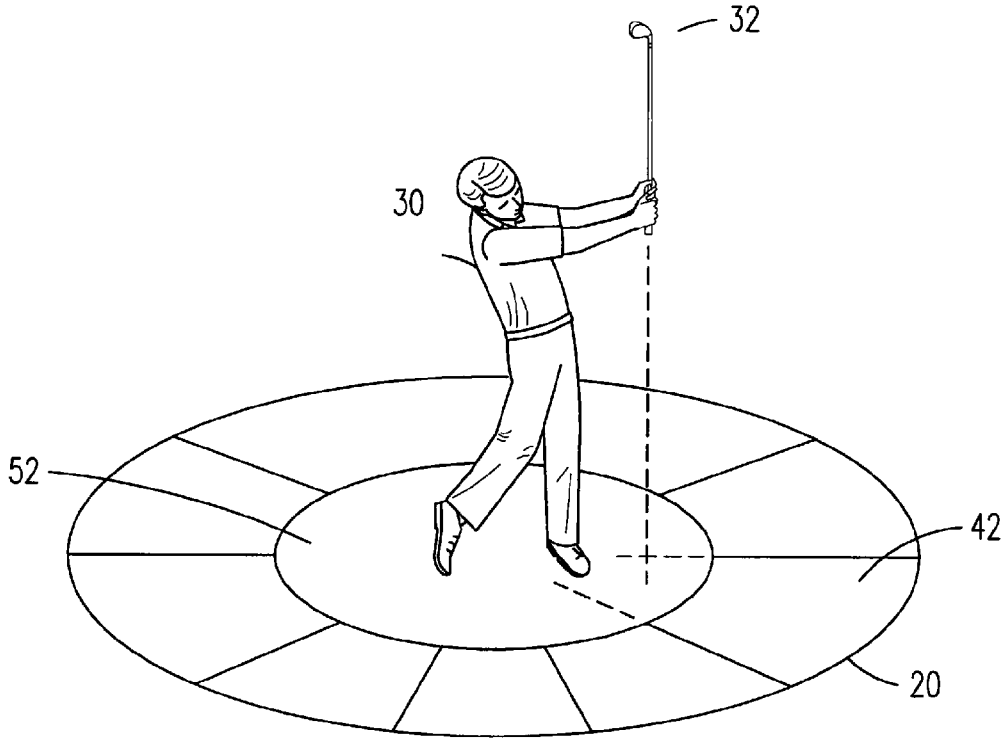
FIG. 4 is a top plan view of an exemplary embodiment of a system for indicating a golf swing region during the top of a followthrough portion of the golf swing region.

FIG. 1 illustrates a system 10 for indicating a plurality of regions (12)(14,16)(18,20)(22,24) of a golf swing. Each region (12)(14,16)(18,20)(22,24) is representative of a distinct golf swing region, as discussed below, and provides a visual guide to a golfer 30 as to the proper position of the top of the backswing and the top of the followthrough for each respective golf swing region. As the golfer 30 continues to practice with the system 10, the proper position of the top of the backswing and the top of the followthrough for each respective golf swing region are ideally memorized for maximum advantage on the golf course. The system 10 may be utilized during golf swing training, with or without golf ball striking. As shown in FIGS. 1 and 3, the system 10 includes a strip 26 to encircle the feet 28 of a golfer 30 who is preparing to conduct the golf swing of a golf club 32. The system 10 may be utilized by golfers of all ages, and thus the strip 26 may be appropriately sized to encircle the feet of various sized golfers, such as children, for example.

As illustrated in FIG. 1, the strip 26 is marked with a plurality of markings (34)(36,38)(40,42)(44,46) for a respective golf swing region (12)(14,16)(18,20)(22,24). In an exemplary embodiment, depending on the golf swing region (12)(14,16)(18,20)(22,24) that the golfer 30 is practicing, the golfer 30 will use one or more of the plurality of markings (34)(36,38)(40,42)(44,46) to properly position the top of the backswing and the top of the followthrough, as discussed below. For each golf swing region (12)(14,16)(18,20)(22,24), the strip 26 is positioned such that during an outer extremity (ie. top of a backswing, top of a followthrough) of the golf swing region (12)(14,16)(18,20)(22,24), the golf club 32 is positioned above a respective marking (34)(36,38)(40,42)(44,46), as discussed further below.

As illustrated in FIGS. 1-4, the strip 26 is placed on a ground surface 52, such as on a golf practice grounds, for example. However, the strip 26 may be positioned on any surface, whether the surface is flat or sloped, that facilitates a golfer 30 engaged in practicing the swinging of the golf club 32 through a golf swing region. In an exemplary embodiment, some golf swing regions, such as a chip shot swing region (14,16), a pitch shot swing region (18,20), and a full swing region (22,24) are marked with a respective pair of markings (36,38)(40,42)(44,46). For each of these golf swing regions (14,16)(18,20)(22,24), the pair of markings (36,38)(40,42)(44,46) includes a backswing marking 36,40,44 above which the golf club 32 is positioned during the top of a backswing portion 14,18,22 of the golf swing region (14,16)(18,20)(22,24). Additionally, the pair of markings (36,38)(40,42)(44,46) further include a followthrough marking 38,42,46 above which the golf club 32 is positioned during a top of a followthrough portion 16,20,24 of the golf swing region. As discussed above, each golf swing region (14,16)(18,20)(22,24) corresponds to a particular golf style shot, including a chip shot swing region (14,16), a pitch shot swing region (18,20) and a full swing region (22,24), for example. However, the golf swing regions of the system 10 are not limited to those discussed herein and may include less or more than a putting region (discussed below), a chip shot swing region, a pitch swing region, and a full swing region, and may be arranged in a different order than presented herein. Such additional swing regions may include, but are not limited to, a punch shot swing region, a cut/slice shot swing region, a hook/draw shot swing region, for example. In the exemplary embodiment of FIGS. 1-4, the golfer 30 practices a pitch shot such that the golf club 32 is positioned above a pitch shot backswing marking 40 (FIGS. 1,3) during the top of a backswing portion 18 of the pitch shot swing region (18,20). Upon completing the practice pitch shot, the golf club 32 is positioned above a pitch shot followthrough marking 20 (FIGS. 2,4) during the top of a followthrough portion 20 of the pitch shot swing region (18,20).

In an exemplary embodiment of the system 10 illustrated in FIG. 1, in addition to the pair of markings (36,38)(40,42)(44,46), a putting region (12) is marked with a single swing range marking (34). The golf club (ie. putter) 32 is positioned above the swing range marking 34 during a top of a backswing portion of the golf swing region 34 and a top of a followthrough portion of the golf swing region 34. As discussed above, the single swing range marking (34) corresponds to a golf style shot, such as putting, for example.

In order to clearly distinguish the markings (34)(36,38)(40,42)(44,46) for each respective swing region (12)(14,16)(18,20)(22,24), each marking (34)(36,38)(40,42)(44,46) may be colored with a respective color for the putting stroke (12), the chip shot (14,16), the pitch shot (18,20) and the full swing (22,24), for example. In an exemplary embodiment, the marking (34) for a putting stroke (12) may be colored blue, the pair of markings (36,38) for a chip shop (14,16) may be colored green, the pair of markings (40,42) for a pitch shot (18,20) may be colored yellow and the pair of markings (44,46) for a full swing (22,24) may be colored red, for example. However, no color arrangement or any color arrangement other than the color arrangement discussed above may be utilized. Additionally, in the exemplary embodiment illustrated in FIG. 3, each marking (34)(36,38)(40,42)(44,46) may be marked with a respective indication 54,56,58,60 of the respective golf style shot (ie. "Putt", "Chip", "Pitch", "Full"). However, each marking need not include this respective indication, or may include an alternate indication than the example discussed above. Additionally, in an exemplary embodiment, a numeric indication 70,72,74,76,78,80,82 may be utilized for each marking (34)(36,38)(40,42)(44,46), consistent with clock positions relative to the markings (34)(36,38)(40,42)(44,46), for example (ie. the numeric indication 70 corresponds to "6 o'clock" for the putting stroke 12, the numeric indication 74 corresponds to "10 o'clock" for the pitch shot 18, etc). These numeric markings 70,72,74,76,78,80,82 conveniently take advantage of the familiar association between angular position and clock position, in order to enhance the learning experience for each golfer. However, each marking need not include this numeric indication, or may include an alternate numeric indication than the example discussed above.

Figure 5:
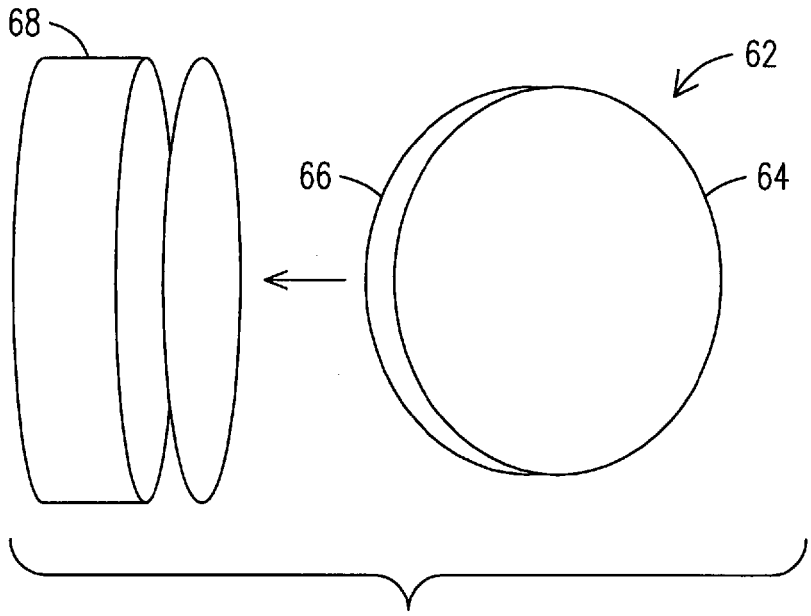
FIG. 5 is a plan view of an exemplary embodiment of a retractable strip to be inserted into a carrying case.

As illustrated in the exemplary embodiment of FIG. 5, the strip 26 includes a circular loop 62 covered by a circular sleeve (not shown), where the circular loop is formed from a retractable material. Although the exemplary embodiment of FIG. 5 discusses the strip 26 including a circular loop 62, and the exemplary embodiment of FIG. 1 discusses that the strip 26 encircles the golfer feet 28, the strip 26 need not be circular but may be oval or may not be an enclosed shape, for example. As illustrated in the exemplary embodiment of FIG. 5, the circular loop 62 is retractable into a pair of coupled loops 64,66 having a smaller diameter than the circular loop 62, and the pair of coupled loops 64,66 may be inserted into a carrying case 68 so that the system 10 may be easily transportable.

Figure 6:
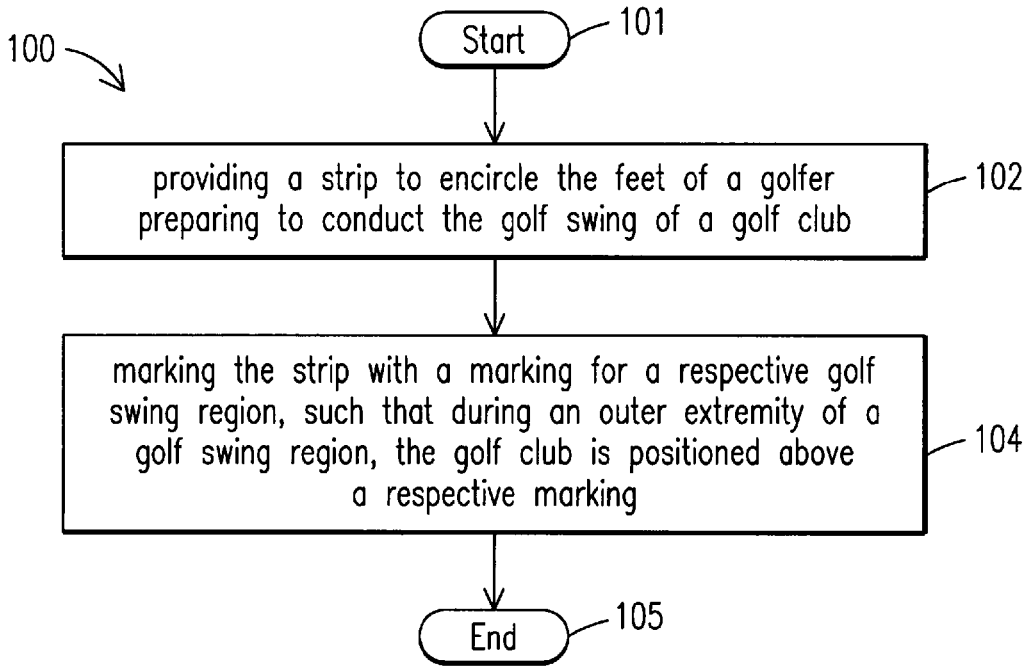
FIG. 6 is a flow chart illustrating an exemplary embodiment of a method of indicating a golf swing region.

FIG. 6 illustrates an exemplary embodiment of a method 100 for indicating at least one region (12)(14,16)(18,20)(22,24) of a golf swing. The method 100 begins (block 101) by providing (block 102) a strip 26 to encircle the feet 28 of a golfer 30 preparing to conduct the golf swing of a golf club 32. The step of providing (block 102) includes marking (block 104) the strip 26 with at least one marking (34)(36,38)(40,42)(44,46) for a respective golf swing region (12)(14,16)(18,20)(22,24), such that during an outer extremity of a golf swing region, the golf club 32 is positioned above a respective marking (34)(36,38)(40,42)(44,46).

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A system for indicating at least one region of a golf swing, said system comprising:

a strip configured to encircle the feet of a golfer preparing to conduct said golf swing of a golf club;

said strip being marked with at least one marking for a respective at least one golf swing region, said strip being positioned such that during an outer extremity of one of said at least one golf swing region, said golf club is positioned above a respective one of said at least one marking.

2. The system of claim 1, wherein said strip is configured to be placed on a ground surface, said strip is marked with a pair of markings for said respective at least one golf swing region, said pair of markings including:

a backswing marking above which said golf club is positioned during a top of a backswing portion of said golf swing region, and a followthrough marking above which said golf club is positioned during a top of a followthrough portion of said golf swing region.

3. The system of claim 2, wherein said at least one golf swing region correspond to at least one respective golf style shot.

4. The system of claim 3, wherein said golf style shot comprises one of a chip shot, a pitch shot and a full swing.

5. The system of claim 4, wherein said pair of markings for said respective at least one golf swing region are colored with a respective color for each of said chip shot, pitch shot and full swing golf style shot.

6. The system of claim 5, wherein said pair of markings for said respective golf swing region are respectively marked with an indication for each of said chip shot, pitch shot and full swing golf style shot.

7. The system of claim 1, wherein said strip is configured to be placed on a ground surface, said strip is marked with one swing range marking for said respective at least one golf swing region, said golf club is positioned above said swing range marking during a top of a backswing portion of said golf swing region and a top of a followthrough portion of said golf swing region.

8. The system of claim 7, wherein said at least one golf swing region corresponds to at least one golf style shot.

9. The system of claim 8, wherein said golf style shot is a putt.

10. The system of claim 9, wherein said swing range marking for said respective golf swing region is colored with a respective color for said putting golf style shot.

11. The system of claim 10, wherein said swing range marking for said respective golf swing region is marked with an indication for said putting golf style shot.

12. The system of claim 1, wherein said strip comprises a circular loop covered by a circular sleeve, said circular loop being formed from a retractable material.

13. The system of claim 12, wherein said circular loop is retractable into a pair of coupled loops having a smaller diameter than said circular loop, said pair of coupled loops configured to be inserted into a carrying case.

14. A system for indicating at least one region of a golf swing, said system comprising:

a strip capable of encircling the feet of a golfer preparing to conduct a golf swing of a golf club;

said strip being marked with at least one marking for a respective at least one golf swing region, said marking being positioned on said strip such that when said strip is positioned about the feet of a golfer preparing to swing the golf club, an outer extremity of said at least one golf swing region of the golf club is identified by a respective one of said at least one marking whereby the golfer can visualize the proper position of the golf club by orienting the golf swing with the marking.

* * * * *